US006356252B2

(12) United States Patent
Park

(10) Patent No.: US 6,356,252 B2
(45) **Date of Patent: *Mar. 12, 2002**

(54) APPARATUS FOR SUPPLYING GRAY LEVEL COMPENSATING VOLTAGE

(75) Inventor: Jae Hong Park, Kyungsangbuk-Do (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/121,268

(22) Filed: Jul. 23, 1998

(30) Foreign Application Priority Data

Jul. 28, 1997 (KR) ..... 97-35571

(51) Int. Cl.[7] ..... G09G 3/36
(52) U.S. Cl. ..... 345/87
(58) Field of Search ..... 345/87, 88, 89, 345/206, 150; 348/673; 385/2, 4, 8, 10

(56) References Cited

U.S. PATENT DOCUMENTS 5,714,895 A * 2/1998 Mori et al. ..... 327/104
5,761,125 A * 6/1998 Himeno ..... 365/185.24
5,841,486 A * 11/1998 Ando et al. ..... 348/673
5,877,736 A * 3/1999 Imajo et al. ..... 345/89
5,926,157 A * 7/1999 Moon ..... 345/89

FOREIGN PATENT DOCUMENTS

JP 06-161389 6/1994
JP 07-219482 8/1995

* cited by examiner

*Primary Examiner*—Almis R. Jankus
(74) *Attorney, Agent, or Firm*—Fleshner & Kim, LLP

(57) ABSTRACT

An apparatus for supplying a gray level compensating voltage in accordance with a preferred embodiment of the present invention minimizes the pad margin of a liquid crystal panel and the size of a liquid crystal display device. The apparatus is provided with a main gamma compensating signal line, which is defined on the liquid crystal panel mounted with a plurality of column driving integrated circuits, for receiving a main gamma compensating voltage. A plurality of conductive patterns is connected to the main gamma compensating signal line. The conductive patterns are arranged to be adjacent to the column driving integrated circuits. Each conductive pattern divides the main gamma compensating voltage from the main gamma compensating signal line into a plurality of divided voltages and applies the divided voltages to the corresponding column driving integrated circuit.

29 Claims, 2 Drawing Sheets

APPARATUS FOR SUPPLYING GRAY LEVEL COMPENSATING VOLTAGE

BACKGROUND OF THE INVENTION

1. Field of the Invention

This invention relates to a display device, and more particularly, to a liquid crystal display device.

2. Background of the Related Art

A liquid crystal display device provides the picture display for a video signal by controlling the light transmissivity of a liquid crystal. The gray level of picture changes non-linearly in accordance with the voltage level of a video signal due to so-called gamma characteristic. This is caused by the fact that: (1) the light transmissivity of the liquid crystal does not change linearly in accordance with the voltage level of the video signal, and (2) the gray level of picture does not change linearly in accordance with the light transmissivity of the liquid crystal. Due to this gamma characteristic, the pictures displayed on a liquid crystal display device are deteriorated.

In order to compensate an error in the gray level, the voltage levels of the video signal for the liquid crystal display device are changed at different intervals using gamma compensating voltages. The number of gamma compensating voltage used in the liquid crystal display device is usually about two to twelve, but increases in proportion to the number of gray levels. Such an increase in the number of gamma compensating voltages not only complicates the wiring and circuitry of the liquid crystal display apparatus, but also enlarges a signal distortion due to parasitic capacitance components and the bulk of the liquid crystal display device.

Such problems are further amplified when driving ICs are mounted on the liquid crystal panel. Generally, a liquid crystal display device includes a liquid crystal panel as a picture display element, driving integrated circuits(ICs) for driving the liquid crystal panel, and an electrical signal modulating circuit for supplying signals required for the driving ICs. The driving ICs were previously installed separately from the liquid crystal panel, but recently they have been mounted on the liquid crystal panel. The liquid crystal panel mounted with the driving ICs is generally referred to as "chips on glass"(COG). In the COG, the driving ICs are installed on the pad region of the liquid crystal panel.

FIG. 1 illustrates a liquid crystal display device 1 using COG. The liquid crystal display device 1 includes an upper glass substrate 10 and a lower glass substrate 12 that are in opposition to each other. Column driving ICs 14 are linearly installed on the pad region near the upper side edge of the lower glass substrate 12. Row driving ICs 16 are installed serially on the pad region near the left side edge of the lower glass substrate 12. An electrical signal modulation circuit 18 supplies signals required for these column driving ICs 14 and row driving ICs 16. Liquid crystal cells arranged in a matrix configuration and having thin film transistors(TFTs) for switching each current path of the liquid crystal cells are formed between the upper glass substrate 10 and the lower glass substrate 12. The column driving ICs 14 drives drain electrodes of the TFTs, and the row driving ICs 16 drives gate electrodes of the TFTs.

A column data signal wiring CSW, a column timing signal wiring CTW and a gamma compensating signal wiring GCW, all of which are connected to the column driving ICs 14, are formed on the upper side pad region of the lower glass substrate 12. A row timing signal wiring RTW and a row signal wiring RSW connected to the row driving ICs 16 are formed on the left side pad region of the lower glass substrate 12. These column data signal wiring CSW, column timing signal wiring CTW, gamma compensating signal wiring GCW, row timing signal wiring RTW and row signal wiring RSW are connected to the electrical signal modulating circuit 18 by means of a flexible circuit substrate 20. Further, a voltage signal wiring and the like (not shown) are formed in the pad regions of the lower glass substrate 12. This voltage signal wiring is connected via the flexible cable to the electrical signal modulating circuit 18 similar to the other wirings.

The gamma compensating wiring GCW in the above wirings generally consists of seven gamma compensating voltage lines in order to deliver seven gamma compensating voltages applied via the flexible circuit substrate 20 from the electrical signal modulating circuit 18 into the column driving ICs 14. Because the number of these gamma compensating voltages is greater than that of other signals, the number of signal lines included in the gamma compensating signal wiring GCW and the number of intersecting points in the signal lines increase. Hence, the gamma compensating signal wiring GCW occupies a wide area of the pad region. The gamma compensating signal wiring GCW also causes a gamma compensating voltage generator to be provided in the electrical signal modulating circuit 18, thereby complicating the circuit configuration. Furthermore, the gamma compensating signal wiring GCW distorts a signal because it generates parasitic capacitance components between the lines. The drawbacks as described above are more and more deteriorated as the gray level of picture increases.

SUMMARY OF THE INVENTION

An object of the present invention is to solve the problems and/or disadvantages of the background art.

Another object of the present invention to minimize the pad margin of a liquid crystal panel.

Another object of the present invention is to minimize the size of a liquid crystal display device.

A further object of the present invention is to simplify the circuit configuration and/or the wiring structure of the liquid crystal display device.

To achieve the present invention in parts or in a whole by a gray level compensating voltage supplying apparatus which includes a main gamma compensating signal line being defined on the liquid crystal panel for delivering a main gamma compensating voltage from the exterior thereof, and at least two conductive patterns being arranged on the liquid crystal panel to be adjacent to the at least two column driving integrated circuits, the at least two conductive patterns each dividing the main gamma compensating voltage from the main gamma compensating signal line into at least two divided voltages and supplying the divided voltages to the adjacent column driving integrated circuits as gamma compensating voltages.

The present invention may be also achieved in parts or in a whole by a gray level compensating voltage supplying apparatus which includes a main gamma compensating signal line being defined on the liquid crystal panel for delivering a main gamma compensating voltage from the exterior thereof, at least two nodes defined on the liquid crystal panel, at least two connectors for cascade-connecting the at least two nodes to the main gamma compensating signal line and for generating divided voltages having different voltage levels on the at least two nodes, and at least three branches for delivering voltages on the at least two nodes and the main gamma compensating signal line into the driving integrated circuit as gamma compensating voltages.

The present invention may be further achieved in parts or in a whole by a liquid crystal display apparatus which includes a main gamma compensating signal line being defined on a liquid crystal panel to receive a main gamma compensating voltage from the exterior thereof, the liquid crystal panel being mounted with a driving integrated circuit, and at least two conductive patterns being formed between the driving integrated circuit and the main gamma compensating signal line, for utilizing the main gamma compensating voltage to apply at least two gamma compensating voltages to the driving integrated circuits.

The present invention may be further achieved in parts or in a whole by a display device comprising: a) a first substrate having a first prescribed dimension; b) a second substrate having a second prescribed dimension, the second substrate being placed in opposition to the first substrate and the first prescribed dimension being greater than the second prescribed dimension such that the second dimension defines a display area region, and a first side pad region being defined by boundaries of the first and second dimensions; c) a plurality of display cells formed on the display area region and between the first and second substrates; d) a plurality of first driving circuits formed on the first side pad region, the first driving circuits selecting corresponding display cells for displaying an image; and e) a compensation circuit formed on the first side pad region, the compensation circuit having: (1) a first conductive line for receiving a first compensation voltage, and (2) a plurality of conductive patterns, each conductive pattern being coupled to the first conductive line and a corresponding first driving circuit, wherein each conductive pattern includes: (i) a plurality of connection nodes coupled to the corresponding first driving circuit, and (ii) a plurality of second conductive lines, the plurality of second conductive lines coupling the plurality of connection nodes in series to the first conductive line such that a plurality of second compensation voltages, which are different from each other, are provide at the plurality of connection nodes, respectively.

The present invention can be also achieved in parts or in a whole by a layout pattern for compensating gamma characteristic of a liquid crystal display panel, comprising: (a) a first conductive line for receiving a first compensation voltage; and (b) a plurality of conductive patterns coupled to the first conductive line, wherein each conductive pattern includes: a plurality of connection nodes, and a plurality of second conductive lines, the plurality of second conductive lines coupling the plurality of connection nodes in series to the first conductive line such that a plurality of second compensation voltages, which are different from each other, are provide at the plurality of connection nodes, respectively.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

A display device of the present invention includes a first substrate and a second substrate having a first prescribed dimension and a second prescribed dimension, respectively. The second substrate is placed in opposition to the first substrate, and the first prescribed dimension is greater than the second prescribed dimension. The second dimension defines a display area region, and first and second side pad region are defined by boundaries of the first and second dimensions.

A plurality of display cells is formed on the display area region between the first and second substrate. A plurality of first and second driving circuits are respectively formed on the first and second side pad regions for selecting corresponding display cells. A compensation circuit or a layout pattern for compensating the gamma characteristic of the display device is formed on the first side pad region.

The compensation circuit or layout pattern includes a first conductive line for receiving a first compensation voltage and a plurality of conductive patterns. Each conductive pattern is coupled to the first conductive line and a corresponding first driving circuit. Further, each of the plurality of conductive patterns is formed between the corresponding first driving circuit and the first conductive line.

Each conductive pattern includes a plurality of connection nodes coupled to the corresponding first driving circuit, and a plurality of second conductive lines. The plurality of second conductive lines couples the plurality of connection nodes in series to the first conductive line such that a plurality of second compensation voltages, which are different from each other, are provide at the plurality of connection nodes, respectively. Each of the plurality of conductive patterns further comprises a plurality of third conductive lines, and each of the plurality of third conductive lines couples a corresponding connection node to the corresponding first driving circuit.

Each of the plurality of second and third conductive lines has a different resistance value. The different resistance value is achieved by providing at least one of different length, thickness and width for each of the plurality of second and third conductive lines. The first conductive line and the plurality of second and third conductive lines are preferably made of a metallic material or a metal wire.

The display device further comprises a modulation circuit which provides control signals to the plurality of first and second driving circuits and the first compensation voltage. A flexible printed circuit substrate couples the modulation circuit to the plurality of first and second driving circuits and the first conductive line.

Figure 2:
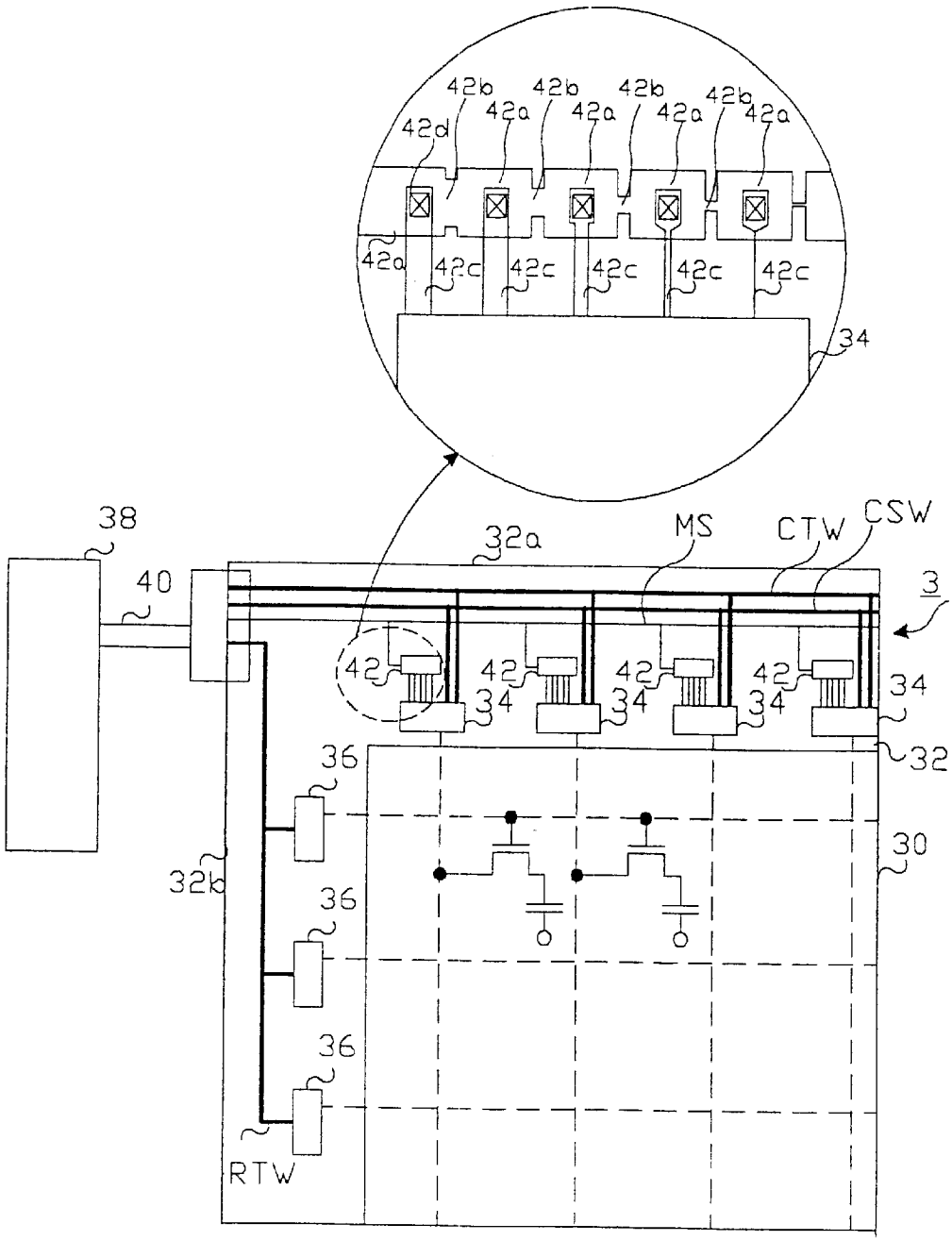
FIG. 2 is a schematic of a liquid crystal display device employing a gray level compensating voltage supplying circuit according to a preferred embodiment of the present invention.

FIG. 2 illustrates a liquid crystal display device 3 according to a specific preferred embodiment of the present invention. An upper glass substrate 30 and a lower glass substrate 32 are provided in opposition to each other. Column driving ICs 34 are linearly installed on the pad region 32*a* near the upper side edge of the lower glass substrate 32. Row driving ICs 36 are serially installed on the pad region 32*b* near the left side edge of the lower glass substrate 32. An electrical signal modulating circuit 38 supplies signals required for these column driving ICs 34 and row driving ICs 36. Liquid crystal cells arranged in a matrix configuration and having thin film transistors(TFTs) for switching each current path of the liquid crystal cells are formed between the upper glass substrate 30 and the lower glass substrate 32. The column driving ICs 34 drives drain electrodes of the TFTs, and the row driving ICs 36 drives gate electrodes of the TFTs.

A column data signal wiring CSW and a column timing signal wiring CTW connected to the column driving ICs 34 are formed in the upper side pad region 32*a* of the lower glass substrate 32. A row timing signal wiring RTW connected to the row driving ICs 36 are formed at the left side pad region 32*b* of the lower glass substrate 12. These column data signal wiring CSW, column timing signal wiring CTW and row timing signal wiring RTW are connected to the electrical signal modulating circuit 38 by means of a flexible printed circuit substrate 40. Further, a voltage signal wiring and the like are formed in the pad regions 32*a* and 32*b* of the lower glass substrate 32. This voltage signal wiring is connected via the flexible printed circuit substrate 40 to the electrical signal modulating circuit 38 similar to the other wirings.

Moreover, conductive patterns 42 adjacent to the column driving ICs 34 and a main gamma compensating signal line MGS commonly connected to the conductive patterns 42 are formed in the upper side pad region 32*a* of the lower glass substrate 32. The main gamma compensating signal line MGS is preferably made of metal to prevent the attenuation voltage. A power supply voltage maintaining a constant voltage level may be used for the main gamma compensating signal. The conductive patterns 42 divides a voltage of main gamma compensating signal from the main gamma compensating signal line MGS into a plurality (e.g., five) of divided voltages different in voltage level, and applies the divided voltages to the adjacent column driving ICs 34.

Each of the conductive patterns 42 includes nodes 42*a* corresponding to the number of gamma compensating voltage determined in accordance with the gray level of picture, and connectors 42*b* for cascade-connecting the nodes 42*a* to the main gamma compensating signal line MGS. Branches 42*c* extend from the nodes 42*a* to the column driving ICs 34. The connectors 42*b* have different resistance values based on different length, thickness and width. Likewise, the branches 42*c* have different resistance values based on different length, thickness and width. In other words, the connectors 42*b* and the branches 42*c* each have a geometrically different structure with respect to each other, resulting in different resistance values.

Further, the respective branches 42*c* are defined by conductive patterns different from the nodes 42*a* and the connectors 42*b* with insulating layers interposed. On the other hand, the nodes 42*a* and connectors are formed in such a manner to be integral with the same conductive layers, respectively. The branches 42*c* are connected via through contact holes 42*d* exposed at the nodes 42*a*.

The voltage of the main gamma compensating signal is divided on the basis of the resistance ratios in the connectors 42*b*, thereby generating gamma compensating voltages having different voltage levels at each node 42*a*. The gamma compensating voltages appearing at each node 42*a* are applied via the branches 42*c* to the column driving ICs 34. Each branch 42*c* each functions to limit a current amount of the gamma compensating voltage applied from each node 42*a* to the column driving IC 34.

Figure 1:
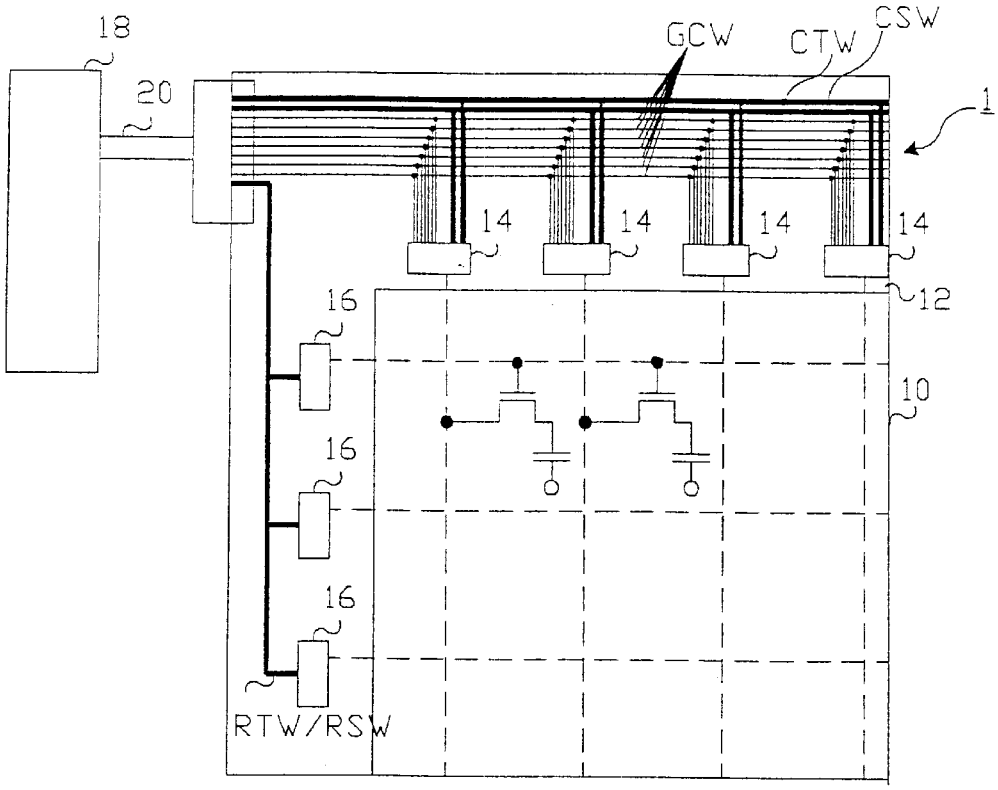
FIG.1 PRIOR ART
FIG. 1 shows schematically a liquid crystal display device of the background art.
Figure 3:
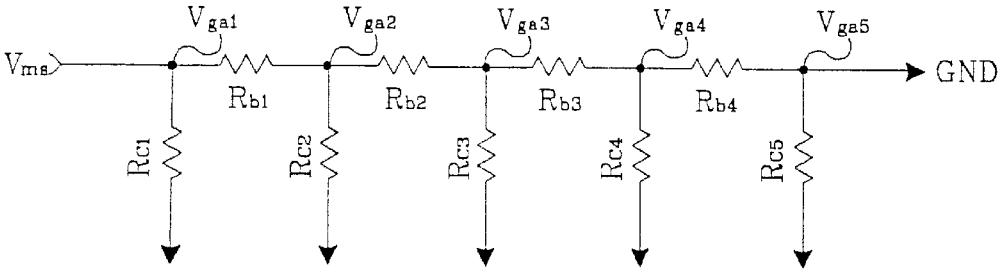
FIG. 3 is an electrical equivalent circuit diagram of a voltage branch part shown in FIG. 2.

FIG. 3 is an electrical equivalent circuit of the conductive pattern 42 of FIG. 2. Four resistors Rb1 to Rb4 represents the resistances of the connectors 42*b*. Five resistors Rc1 to Rc5 represents the resistances of the branches 42*c*. Five gamma compensating divided voltages Vga1 to Vga5 generated at each of five nodes 42*a* are produced by dividing a main gamma compensating signal Vms in accordance with the resistance ratios of four resistors Rb1 to Rb4.

As described above, the conductive pattern defined in the pad region of the liquid crystal panel adjacent to the column driving ICs serves as a gamma compensating voltage supplying apparatus to simplify the circuit configuration of the electrical signal modulation device. The gamma compensating voltage supplying apparatus requires only a single voltage line from the electrical signal modulation device, so that a panel margin of the liquid crystal panel is minimized. Moreover, the gamma compensating voltage supplying apparatus requires only a single voltage line from the electrical signal modulation device, so that the parasitic capacitance component is minimized and the signal distortion is prevented.

The foregoing embodiments are merely exemplary and are not to be construed as limiting the present invention. The present teaching can be readily applied to other types of apparatus. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalent structures.

What is claimed is:

1. In a liquid crystal display device having a plurality of column driving integrated circuits mounted on a liquid crystal panel, an apparatus for supplying a gray level compensating voltage, comprising:

a main gamma compensating signal line being defined on said liquid crystal panel for receiving a main gamma compensating voltage; and a plurality of conductive patterns being arranged on said liquid crystal panel to be adjacent to said plurality of column driving integrated circuits, each of said plurality of conductive patterns dividing said main gamma compensating voltage from said main gamma compensating signal line into a plurality of divided voltages and supplying the divided voltages to the adjacent column driving integrated circuits as gamma compensating voltages.

2. The apparatus of claim 1, wherein said main gamma compensating voltage is a constant power supply voltage.

3. The apparatus of claim 1, wherein each of said conductive patterns has a different geometric structure.

4. In a liquid crystal display device having a driving integrated circuits mounted on a liquid crystal panel, an apparatus for supplying a gray level compensating voltage, comprising:

a main gamma compensating signal line being defined on said liquid crystal panel for receiving a main gamma compensating voltage;

a plurality of nodes defined on said liquid crystal panel;

a plurality of connectors for cascade-connecting said plurality of nodes to said main gamma compensating signal line and for generating divided voltages having different voltage levels at said plurality of nodes; and a plurality of branches for outputting voltages on said plurality of nodes and said main gamma compensating signal line into said driving integrated circuit as gamma compensating voltages.

5. The apparatus of claim 4, wherein said plurality of connectors has different length, thickness and width from each other such that said plurality of connectors has different resistance values.

6. The apparatus of claim 4, wherein said plurality of branches has different thickness and width to limit a current applied to the driving integrated circuit.

7. The apparatus of claim 4, wherein said connectors are disposed on conductive layers different from said nodes and said branches are connected via through holes to said nodes, respectively.

8. The apparatus of claim 7, wherein said main gamma compensating voltage is a constant power supply voltage.

9. The apparatus of claim 8, wherein said main gamma compensating signal line is made of metal.

10. A liquid crystal display apparatus, comprising:

a main gamma compensating signal line being defined on a liquid crystal panel for receiving a main gamma compensating voltage, said liquid crystal panel being mounted with a driving integrated circuit; and a plurality of conductive patterns being formed between said driving integrated circuit and said main gamma compensating signal line, for utilizing said main gamma compensating voltage to apply a plurality of gamma compensating voltages to said driving integrated circuit.

11. A display device comprising:

a) a first substrate having a first prescribed dimension;

b) a second substrate having a second prescribed dimension, said second substrate being placed in opposition to said first substrate and said first prescribed dimension being greater than said second prescribed dimension such that said second dimension defines a display area region, and a first side pad region being defined by boundaries of said first and second dimensions;

c) a plurality of display cells formed on the display area region and between said first and second substrates;

d) a plurality of first driving circuits formed on said first side pad region, said first driving circuits selecting corresponding display cells for displaying an image; and e) a compensation circuit formed on said first side pad region, said compensation circuit having:

(1) a first conductive line for receiving a first compensation voltage, and (2) a plurality of conductive patterns, each conductive pattern being coupled to said first conductive line and a corresponding first driving circuit, wherein each conductive pattern includes:

(i) a plurality of connection nodes coupled to the corresponding first driving circuit, and (ii) a plurality of second conductive lines, said plurality of second conductive lines coupling said plurality of connection nodes in series to said first conductive line such that a plurality of second compensation voltages, which are different from each other, are provide at said plurality of connection nodes, respectively.

12. The display device of claim 11, wherein each of said plurality of second conductive lines has a different resistance value.

13. The display device of claim 11, wherein each of said plurality of second conductive lines has at least one of different length, thickness and width.

14. The display device of claim 11, wherein each of said plurality of conductive patterns further comprises a plurality of third conductive lines, each of said plurality of third conductive lines coupling a corresponding connection node to the corresponding first driving circuit.

15. The display device of claim 14, wherein each of said plurality of third conductive lines has a different resistance value.

16. The display device of claim 14, wherein each of said plurality of third conductive lines has at least one of different length, thickness and width.

17. The display device of claim 14, wherein said first conductive line and said plurality of second and third conductive lines are metallic.

18. The display device of claim 11, wherein a second side pad region is defined by the boundaries of said first and second dimensions, and further comprising a plurality of second driving circuits for selecting corresponding display cells.

19. The display device of claim 18, wherein said first side pad region is an upper side pad region, and said second side pad region is a left side pad region.

20. The display device of claim 18 further comprising a modulation circuit which provides control signals to said plurality of first and second driving circuits and the first compensation voltage to the first conductive line.

21. The display device of claim 18 further comprising a flexible printed circuit substrate for coupling said modulation circuit to said plurality of first and second driving circuits and said first conductive line.

22. The display device of claim 11, wherein each of said plurality of conductive patterns are formed between the corresponding first driving circuit and the first conductive line.

23. A layout pattern for compensating a gamma characteristic of a liquid crystal display panel, comprising:

(a) a first conductive line for receiving a first compensation voltage; and (b) a plurality of conductive patterns coupled to said first conductive line, wherein each conductive pattern includes:

a plurality of connection nodes, and a plurality of second conductive lines, said plurality of second conductive lines coupling said plurality of connection nodes in series to said first conductive line such that a plurality of second compensation voltages, which are different from each other, are provide at said plurality of connection nodes, respectively.

24. The layout pattern of claim 23, wherein each of said plurality of second conductive lines has a different resistance value.

25. The layout pattern of claim 23, wherein each of said plurality of second conductive lines has at least one of different length, thickness and width.

26. The layout pattern of claim 23, wherein each of said plurality of conductive patterns further comprises a plurality of third conductive lines coupled to said plurality of connection node, respectively, each third conductive line limiting a current output to compensate for the gamma characteristic.

27. The layout pattern of claim 26, wherein each of said plurality of third conductive lines has a different resistance value.

28. The layout pattern of claim 26, wherein each of said plurality of third conductive lines has a t least one different length, thickness and width.

29. The layout pattern of claim 23, wherein said first conductive line and said plurality of second and third conductive lines are metallic.

* * * * *